US005135316A

United States Patent [19]

Kuramitsu et al.

[11] Patent Number: 5,135,316

[45] Date of Patent: Aug. 4, 1992

[54] AUTOMATIC PRINT HEAD POSITION ADJUSTING MECHANISM

[75] Inventors: Wataru Kuramitsu; Joji Shimokawa, both of Chofu, Japan

[73] Assignee: Juki Corporation, Chofu, Japan

[21] Appl. No.: 523,743

[22] Filed: May 15, 1990

[51] Int. Cl.[5] ..... B41J 3/63

[52] U.S. Cl. ..... 400/57; 400/59

[58] Field of Search ..... 400/56, 355, 57, 59

[56] References Cited

U.S. PATENT DOCUMENTS

| | | | |
|---|---|---|---|
| 3,981,235 | 9/1976 | Thomas et al. | 101/93.14 |
| 4,420,269 | 12/1983 | Ackermann et al. | 400/56 |
| 4,652,153 | 3/1987 | Kotsuzumi | 400/56 |
| 4,676,675 | 6/1987 | Suzuki | 400/56 |
| 4,893,949 | 1/1990 | Limberger et al. | 400/56 |
| 4,927,277 | 5/1990 | Niikawa | 400/56 |
| 4,990,004 | 2/1991 | Kawahara et al. | 400/56 |
| 5,051,008 | 9/1991 | Honda et al. | 400/59 |

FOREIGN PATENT DOCUMENTS

| | | | |
|---|---|---|---|
| 3743677 | 12/1987 | Fed. Rep. of Germany . | |
| 0059090 | 4/1983 | Japan | 400/56 |
| 0041278 | 3/1984 | Japan | 400/56 |
| 0171377 | 8/1986 | Japan | 400/56 |
| 0187063 | 8/1987 | Japan | 400/56 |
| 0187064 | 8/1987 | Japan | 400/56 |

*Primary Examiner*—Clifford D. Crowder
*Assistant Examiner*—John S. Hilten
*Attorney, Agent, or Firm*—Morgan & Finnegan

[57] ABSTRACT

An apparatus adapted to adjust an interval or gap between a print head carried by a carrier unit and a printing paper disposed on a platen by sensing a paper thickness to obtain the optimum position of the print head without stepping-out a motor, including a holder, pulley, shielding plate, and a cam to rotate not only the holder and pulley with respect to the cam, but also the shielding plate with respect to the pulley independently of each other against the cam at a predetermined angle so that characters of a high quality may be printed on the printing paper.

2 Claims, 7 Drawing Sheets

AUTOMATIC PRINT HEAD POSITION ADJUSTING MECHANISM

BACKGROUND OF THE INVENTION

1. Field of the Invention

This invention relates to an automatic print head position adjusting mechanism, and more particularly to an automatic adjusting apparatus for printers such as a dot printer and the like which automatically adjust a space or a gap between a printing head and a printing paper according to the thickness of the printing paper to set the printing head to the optimum position.

2. Prior Art

Sharp and clear characters or legends can not be printed unless the space between the printing head and the paper is properly adjusted when the characters are printed. Furthermore, this space should be suitably adjusted so as to accommodate the thickness of the printing paper.

The apparatus which have been used to this end are disclosed as in Japanese Patent Laid-Open Applications Nos. Sho 60-56202 and 61-199969.

Application No. Sho 60-56202 deals with an automatic paper thickness detector mechanism for a printer, which comprises a carriage having one end loosely supported by a fixed spindle and having the other end slidably and loosely mounted in an eccentric member. The carriage is movable in the axial direction of the rotary shaft parallel to the fixed spindle. The paper thickness detecting mechanism further includes a paper thickness detecting member adapted to abut against a platen when the carriage is swung, a spring for energizing the rotary shaft toward a part of the platen, and a drive motor for rotating the rotary shaft a certain extent in a direction opposite to the direction in which the spring is energized.

Application No. Sho 61-199969 discloses an automatic head gap adjusting mechanism for a printer which includes a movable printing head energized to an advanced position, a platen movable back and forth in opposition to the print head, and a sensor for detecting when the print head is a given distance away from the platen. The head gap adjusting mechanism operates such that the platen is advanced to the print head with the printing paper being between the print head and the platen, and that the platen is moved away a given distance from the starting point; i.e., to a where the sensor serves for detection.

In addition to the aforementioned apparatus and mechanisms, prior art print head adjusting mechanisms have employed step-out methods for a stepping motor, slip methods relying on a torque limiter and pre-sensing methods.

Application No. Sho 60-56202 discloses a system in which it is difficult to obtain accuracy when printing and thus fails to maintain print quality since a carriage is pivoted about the fixed spindle. A disadvantage derived from Application No. Sho 61-199969 is that the printer is required to provide a greater space between the print head and platen since the positioning of the platen is based on moving the print head back away from the platen and by an accompanying advancement and moving away of the platen, thereby adjusting the head gap.

A disadvantage of apparatus or mechanisms which use a step-out method for the stepping motor is the difficulty in recognizing a layer just before the print head is moved from the step-out position and back therefrom; i.e., the step-out position. This involves a loss to the operation under which less than four steps will destroy positional accuracy of the print head and deteriorate printing quality.

A drawback to pre-sensing methods providing a given feed system is that paper thickness sensors are costly and require a more constructive space.

SUMMARY OF THE INVENTION

These and other problems inherent in the conventional apparatus and mechanisms for automatically adjusting print head positions are solved by the present invention which is designed to determine whether the head or the stepping motor is stopped in a position close to the step-out position based on the step-out method.

More specifically, in the past, a head position could not be accurately detected, because, when sensing a step-out point through a slit in an encoder, the method for detecting the slit is a digital process whereas a print head position is a type of analogue numerical value which is determined according to a paper thickness. In order to fully find the print head position, it is necessary to prepare an extremely fine slit; i.e., a slit of high resolution. However, the conventional approach is not cost efficient. For this reason, in accordance with the invention, there is provided a step-out area absorption mechanism which relies on inexpensive sensing by the use of a conventional photo-sensor and a print head position adjusting mechanism.

An advantage of the invention is that the carrier unit is quickly set to a desired position by an inexpensive sensor or switch without stepping-out the stepping motor.

Another advantage of the invention is that the print head position is continually and precisely adjusted without committing sensing error, which may be otherwise derived from variations caused by the step-out.

A further advantage of the invention is that the instant adjusting mechanism is mounted in a narrow space without having to modify all the dimensions of the apparatus.

Another advantage of the present invention is that the position adjusting mechanism is of a compact and simple structure which may be readily incorporated in the existing apparatus.

According to the present invention, an automatic print head position adjusting mechanism is provided for adjusting a position of a carrier unit having a print head. The print head adjusting mechanism is able to print characters of high quality on a paper disposed between the carrier unit and a platen, which adjusting mechanism comprises at least a pair of frames; a spindle loosely fitted into openings formed in the frames and slidably supporting the carrier unit in its axial direction; a cam member outwardly of the frame and rigidly mounted on at least one end of the spindle; a holder for limiting rotation of the cam member on the spindle and having a detector; a pulley rotatable independently of the cam member on the spindle; a shielding plate for limiting rotation of the pulley on the spindle; springs for raising the opposite ends of the spindle from the surface of the paper; a roller engageable with the cam member for disposing the spindle in a predetermined position against the increased force of the springs; and a stepping motor for rotating the pulley via a belt. The adjusting mechanism further includes respective springs for supporting the holder and the cam, the cam and pulley, and the pulley and shielding plate, all in a pull relation with each other. The holder, pulley and shielding plate are independently rotatable with respect to the cam and the pulley. The shielding plate is actuated in association with the detector to position the print head to a precise printing position without stepping-out the stepping motor.

PREFERRED EMBODIMENT OF THE INVENTION

Figure 1:
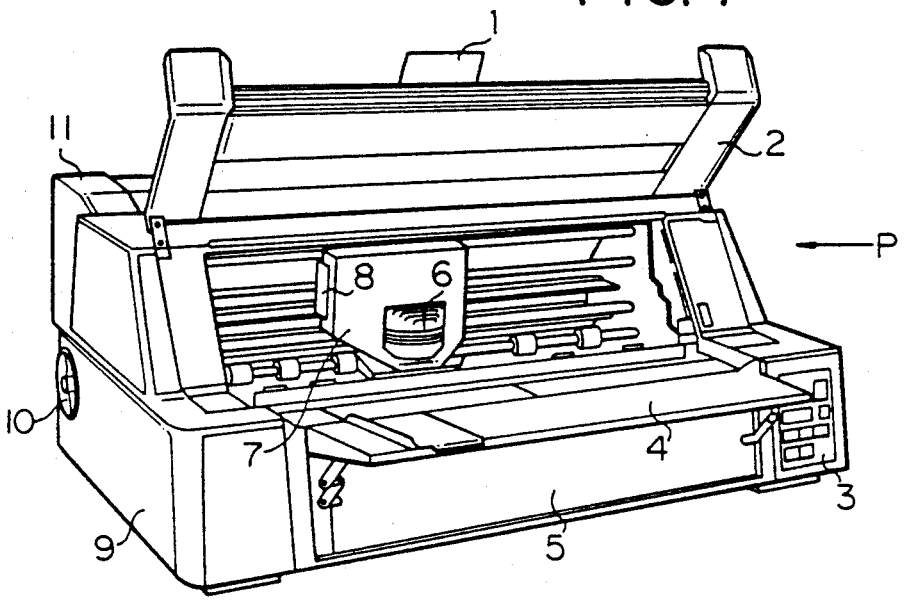
FIG. 1 is a perspective view of a printer as a whole in which is incorporated a print unit or head position mechanism according to the invention.
Figure 2:
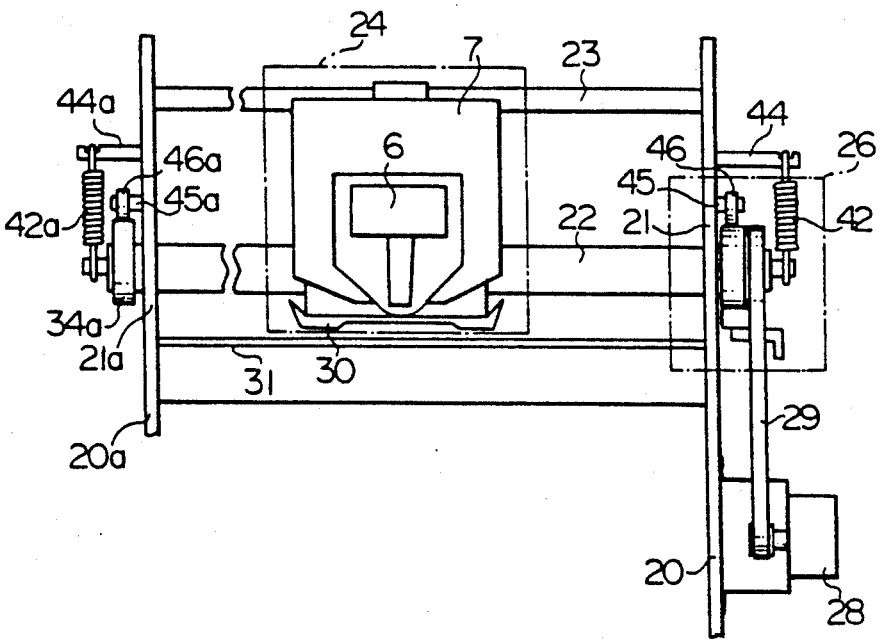
FIG. 2 is a schematic representation of the components of the present invention.

FIG. 1 is a perspective view of a printer P as a whole in which an automatic print unit or head position adjusting mechanism of the invention is incorporated. FIG. 2 is a schematic view illustrative of the components of the invention. As shown, the printer P is composed of a paper support 1, a top cover 2, a control panel 3, a paper table 4, a front cover 5, a print head 6, a ribbon cassette 7, a carriage 8, a center cover 9, and a paper feed knob 10. The line printer P is provided on one side or rear side thereof with a power switch, a fuse, and a plug socket or the like.

The present invention is contemplated, as shown in FIG. 2, so that a spindle 22, opposite ends of which are supported by side frames 20 and 20*a* inwardly of the center cover 9, is adapted to adjust its position by means of a position adjusting unit 26 and a stepping motor 28 so as to adjust a position of a carrier unit 24 supported by the spindle 22 to the optimum printing position. In this connection, it is noted that the print head 6 (FIG. 2) is adapted to print characters on a printing paper fed between a paper abutment, that is, between a paper guide 30 and a platen 31 by means of a ribbon of a kind well known in the art, supplied from the ribbon cassette 7. The carrier unit 24 is formed on its top with a channel or a bore of a given depth to receive therein an upper shaft 23. The channel is dimensioned to allow vertical movement of the carrier unit 24 and is slidable with respect to the upper shaft 23.

Figure 3:
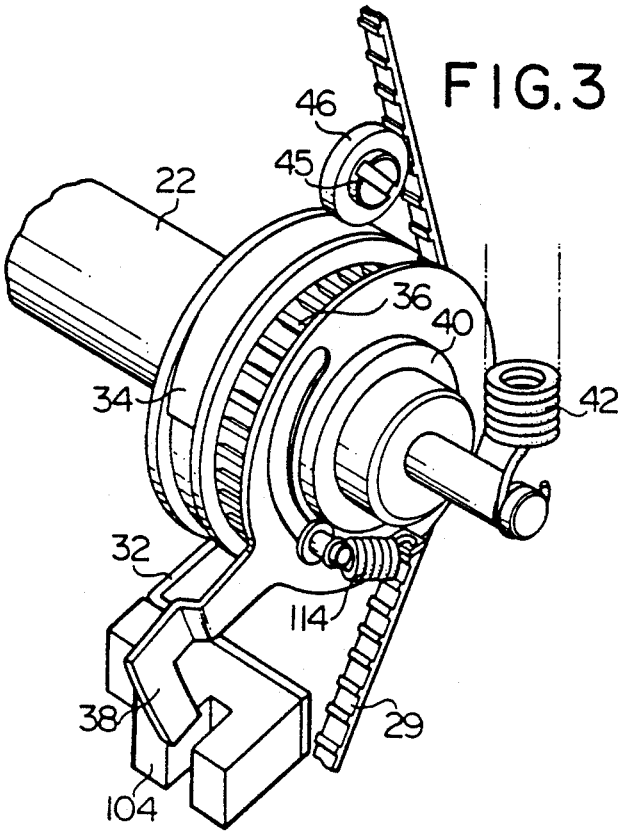
FIG. 3 is a fragmental perspective view of a position adjusting unit of the invention.
Figure 4:
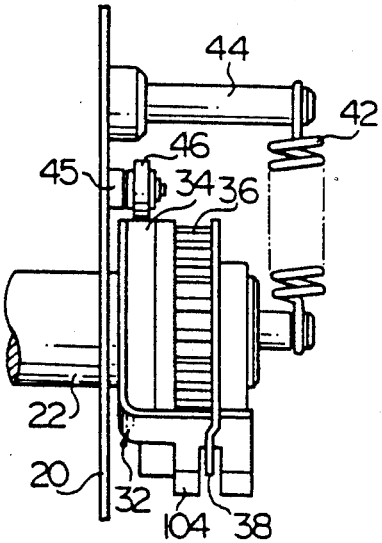
FIG. 4 is a front view of the unit shown in FIG. 3.
Figure 5:
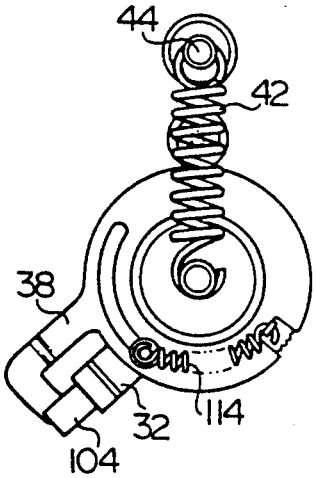
FIG. 5 is a side view of the unit shown in FIG. 3.

Referring to FIGS. 3, 4 and 5, the position adjusting unit 26 is placed on the spindle 22 extended outwardly of the frame 20 (only one shown) through a hole 21 (FIG. 2) formed therein. The unit 26 comprises a sensor holder 32, a cam 34 fixed to the spindle 22 and adapted to pivotally receive the center of the sensor holder 32, a pulley rotatably carried on the spindle 22, and a sensor shielding plate 38.

A latch 40 is provided outwardly of the shielding plate 38 to mount the spindle 22 by a retainer well known per se (not shown) to prevent the pulley 36 and the shielding plate 38 from separating from the spindle shaft 22. A spring 42 has one end which is supported on one end of the spindle 22 and the other end which is supported on a spring support pin 44 fixed to the frame 20 to normally energize the spindle 22 and the unit 26 toward the spring support pin 44.

Another pin 45 located downwardly of the support pin 44 is secured to the frame 20 and carries a rotatable roller 46. The roller 46 interacts with the cam 34 to limit upward movement of the unit 26. The roller 46 serves to lower or raise the carrier unit 24 when the cam 34 is rotated counterclockwise or clockwise in a manner as described later.

Another position adjusting unit similar to the unit 26 is mounted on the other end of the spindle 22 and supported by a cam 34*a* and a spring 42*a* (FIG. 2) similar to those included in the first mentioned position adjusting unit 26. The cam 34*a* and the spring 42*a* are held in position by a roller 46*a* and by a pin 44*a* in a similar manner as those of the unit 26. The roller 46*a* is rotatably mounted to a pin 45*a* which is fixed to a frame 20*a*.

Figure 6:
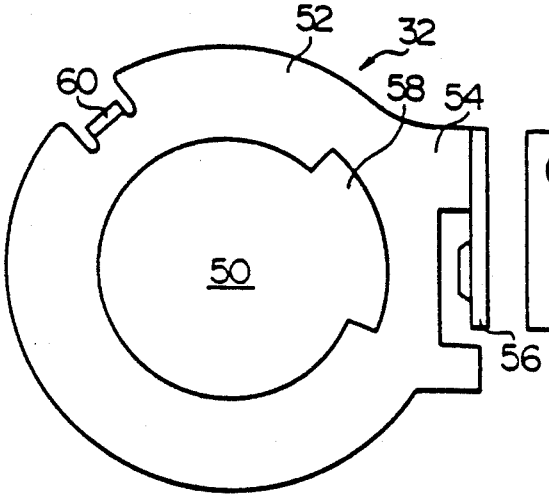
FIG. 6 is a front view of a sensor holder.
Figure 7:
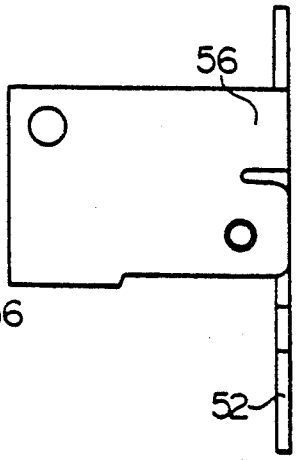
FIG. 7 is a bottom view of the sensor holder shown in FIG. 6.

The sensor holder 32 shown in FIGS. 6 and 7 includes a disc member 52 with a hole 50 through which the spindle 22 passes, a leg portion 54, and a sensor holding member 56 extended perpendicularly to one end of the leg portion 54. The central hole 50 is provided with a cutout 58 in the form of an arc concentric with the central hole 50. The disc member 52 is formed on the periphery thereof with a spring shoe 60 extended in the same direction as in the sensor holding member 56.

Figure 8:
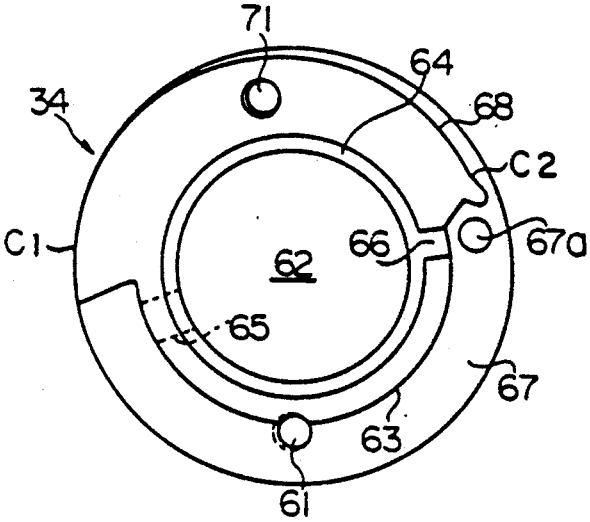
FIG. 8 is a front view of a cam.
Figure 9:
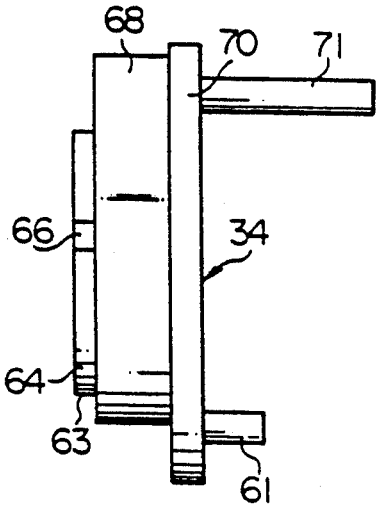
FIG. 9 is a side view of the cam of FIG. 8.

Referring now to FIGS. 8 and 9, the cam 34 includes at its center a hole 62 through which the spindle 22 passes and is provided on one side with a hub 64. The hub 64 is rotatably received in the hole 50 in the sensor holder 32. A radially extending lug 66 is formed on a portion of the hub 64 and is received in the cutout 58. A cam surface 68 is formed inside the hub 64 and circumferentially extends from a starting point $C_1$ to a terminus $C_2$ to cover an arc of about 150°. A stepped portion 63 of a certain radius circumferentially extends from the terminus $C_2$ to the starting point $C_1$ and is provided in its portion with a tapped hole 65 which terminates at the hole 62. A set screw is threaded into the tapped hole 65 to firmly mount the cam 34 to the spindle 22. The cam 34 includes on the side opposite the hub 64 a disc member 70 of a diameter substantially equal to the outer diameter of the disc member 52 of the sensor holder 32.

Figure 12:
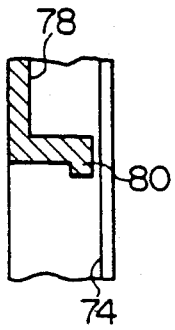
FIG. 12 is a view showing the pulley looking in the direction of arrows XII—XII.
Figure 10:
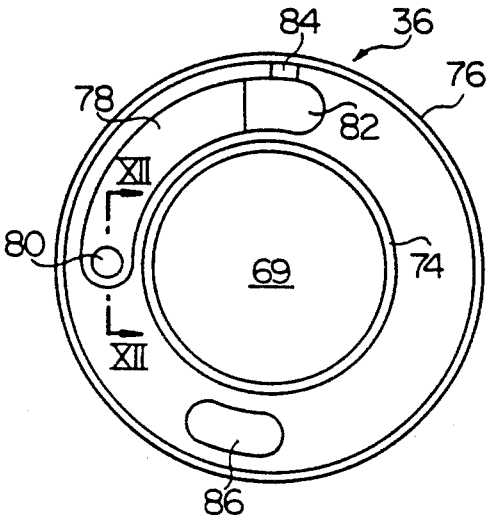
FIG. 10 is a front view of a pulley.
Figure 11:
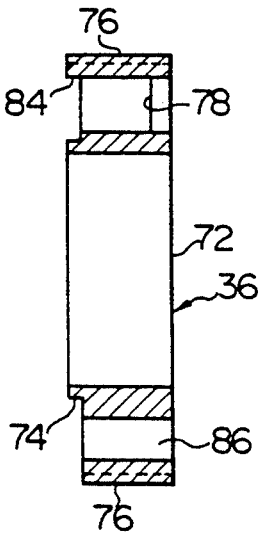
FIG. 11 is a side elevation of the pulley of FIG. 10.

Referring to FIGS. 10, 11 and 12, the pulley 36 is provided at its center with a hole 69 adapted to receive the spindle 22 therein. Formed peripherally of the hole 69 in a surface opposite to a surface 72 in contact with the disc member 70 of the cam 34 (FIG. 9) is a hub 74 which is similar to the hub 64 of the cam 34. An indented rim 76 is formed on the entire periphery of the pulley 36. An arcuate recess 78 is formed between the rim 76 and the hub 74 that is concave in shape and allows the pulley 76 to rotate with respect to the cam surface to cover an arc of about 90°. The arcuate recess 78 is formed at one end with an upright segment 80 to engage one end of a spring and at the other end with an opening 82 open to the cam surface. The indented rim 76 has on its periphery a lug 84 similar to the lug 66 of the cam 34. Another opening 86 is formed in the recess 78 to be diametrically opposed to the opening 84. The pulley 36 is rotatably driven by a belt 29 (FIG. 2) which is actuated by the stepping motor 28 fixed to the frame 20.

Figure 13:
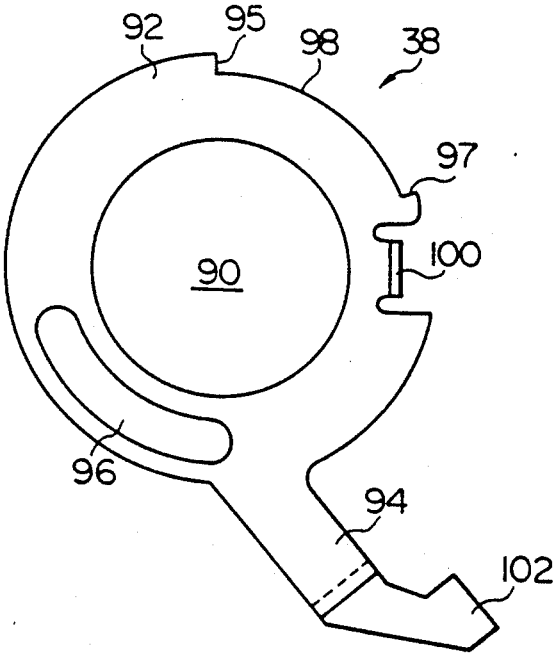
FIG. 13 is a front view of a sensor shielding plate.

The shielding plate 38 shown in FIG. 13 comprises a disc member 92 with a hole 90 formed centrally therein to receive the hub 74 of the pulley 36, and a leg portion 94 extending substantially radially outward from the plate 38. The disc member 92 has a slot 96, a cutout 98 diametrically opposed to the slot 96 concentric with the disc member 92, and an upright segment 100 for engaging a spring. The leg portion 94 is provided at one end with a cover tongue 102 which is preferably integrated therewith to shield a sensor 104 (FIG. 3) fixed to a sensor support portion 56 of the holder 32.

The cam 34 secured to the spindle 22 further includes a pin 67*a* (FIG. 8) which extends from a flange 67 of the cam and in parallel with the lug 66 of hub 64. A spring 110 (FIG. 14) extends along the stepped portion 63 and includes one end supported by the pin 67*a* and the other end carried by a spring shoe 60 formed on the sensor holder 32. The spring 110 normally imparts turning force to the sensor holder 32 in the clockwise direction as viewed from the perspective of the position adjusting unit in FIG. 3. In this instance, it is noted that rotation of the sensor holder 32 and the cam 34 are limited by engagement of the lug 66 with the cutout 58 in the sensor holder.

Another pin 61 (FIGS. 8 and 9) is rigidly mounted on the cam 34 so as to symmetrize the pin 67*a*. The pin 61, which extends through the opening 82 to the recess 78, is adapted to support one end of a spring 112 (FIG. 14), the other end of which is carried by the upright segment 80.

Figure 14:
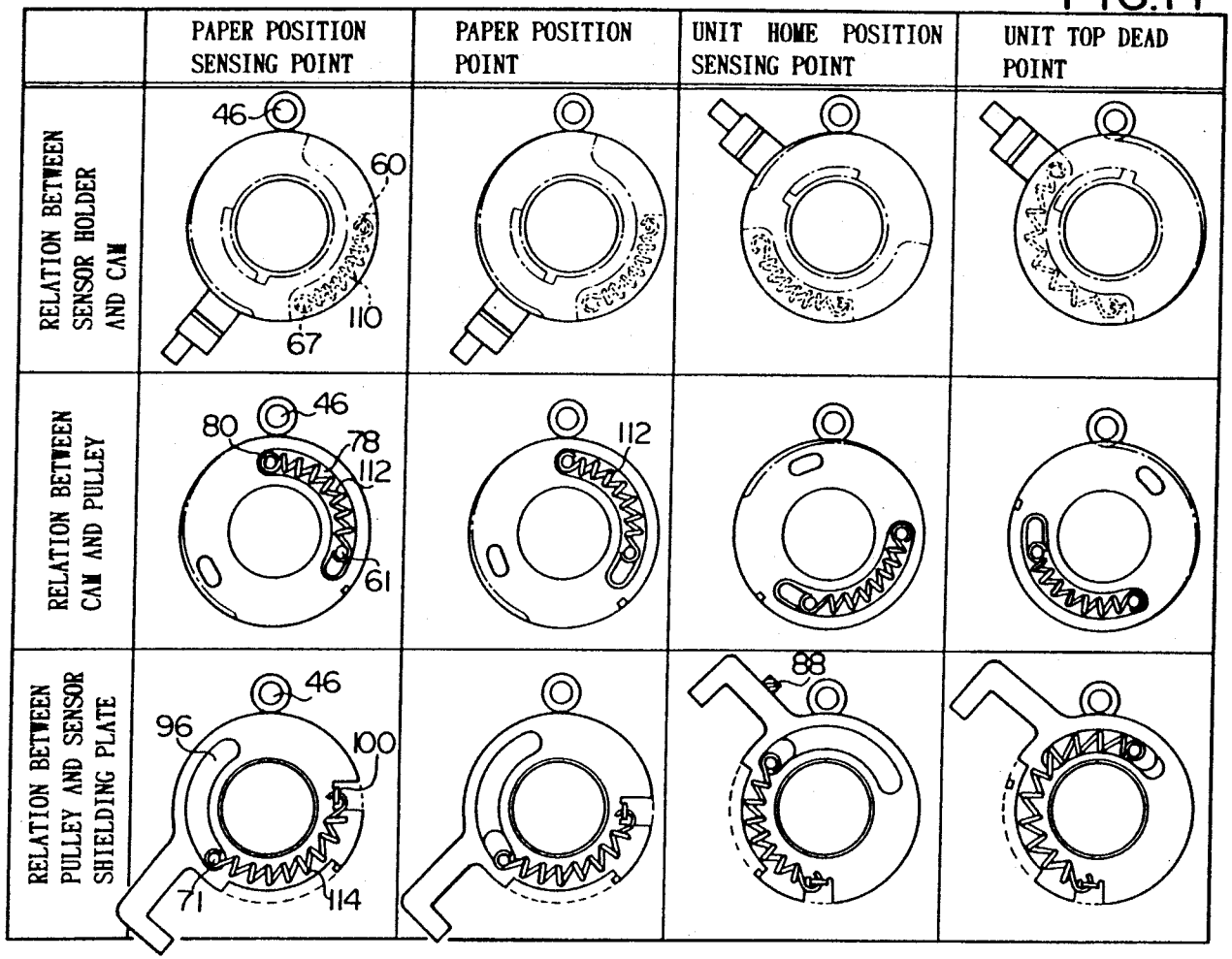
FIG. 14 shows the orientation of the sensor shielding plate at various points.

Another elongated pin 71 (FIGS. 8 and 9) projects from the cam 34 in the same direction as the pin 61 and passes through the opening 86 in the pulley 36 and the slot 96 in the sensor shielding plate 38. The pin 71 is further projected out of the shielding plate 38 to support one end of a spring 114 (FIG. 14). The other end of spring 114 is carried by the upright segment 100 of the shielding plate 38.

With this arrangement, the pulley 36 is freely rotatable against the bias of the spring 112 to the extent that the pins 61 and 71, extended from the cam, are loosely moved in the openings 82 and 86 respectively. In a normal condition, the pins 61 and 71 of the cam 34 are urged counterclockwise against the left end of the opening 82 and the right end of the opening 86 respectively, thereby stopping movement of the pins.

The sensor shielding plate 38 (FIG. 13) is freely rotated with respect to the pulley 36 (FIG. 12) to the extent allowed by the lug 84 of the pulley 36 moving in the cutout 98 in the shielding plate 98. However, the lug 84 of the pulley 36 is normally prevented from moving in a position where the lug abuts against a stopper 95 of the shielding plate 38.

In an alternative embodiment, the pin 71 may be fixed to the pulley 36.

As shown in FIG. 5, the shielding plate 38 is not normally allowed to shield a sensor or switch 104 held by the holder 32. However, the shielding plate 38 can shield the sensor 104 by rotating both the lug 84 of the pulley 36 (FIG. 10) and the shielding plate 38 counterclockwise against the bias of the spring 112. Further rotation of the pulley 36 within the openings 82 and 86 will cause the shielding plate 38 to slightly rotate the sensor holder 32 against the bias of the spring 110 in the same direction, while the sensor shielding plate 38 closes the sensor 104.

The present invention operates as follows.

The initial position of the carrier unit with respect to the printing paper is sensed. Then, the carrier unit 24 is moved back from the position where the paper is disposed, in order to effect the optimum printing operation. The carrier unit is set to a position where the used ribbon may be exchanged for new ribbon.

It is noted that both the feeding of the paper through the printer and the printing of characters upon the paper are performed by methods well known in the art.

Figure 15:
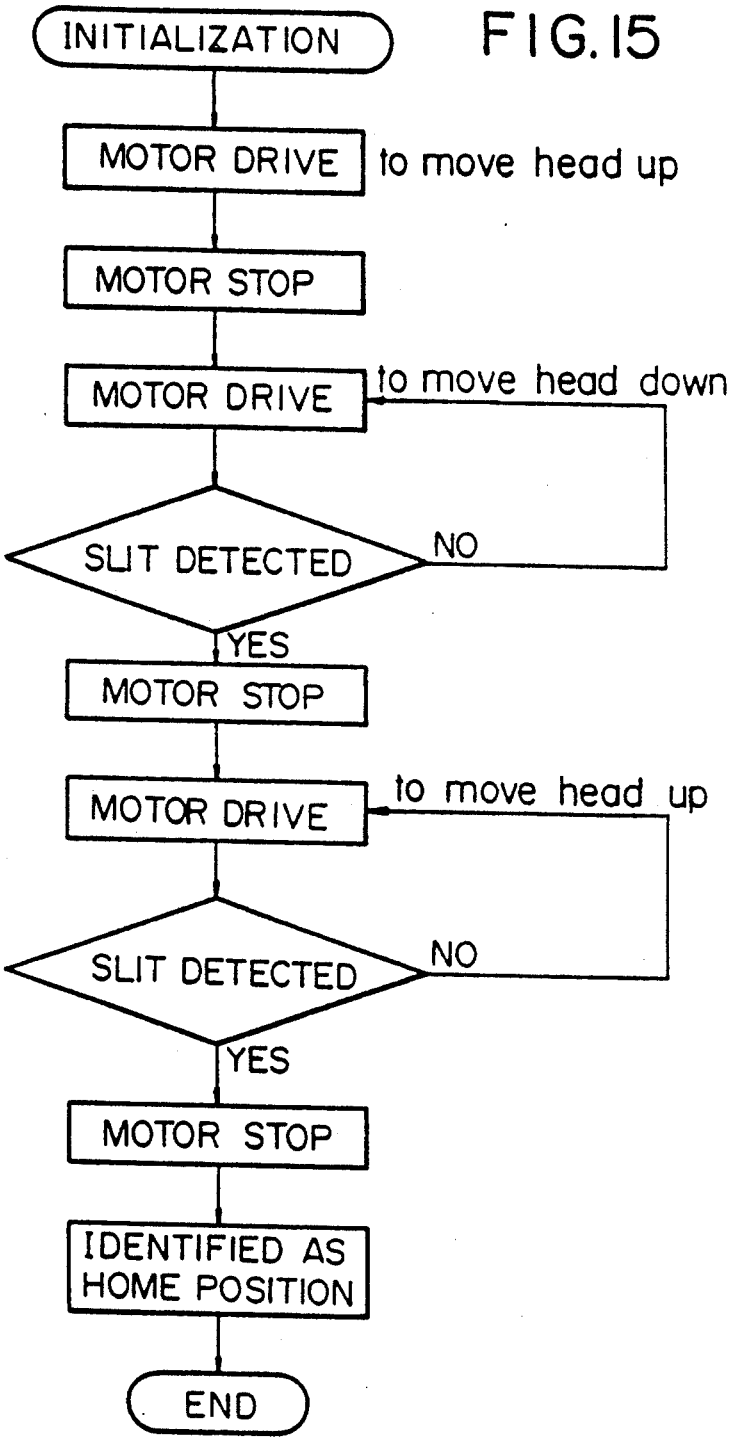
FIG. 15 is a flow chart showing the sequence of the position adjusting unit of the invention wherein it is raised to its home position.

For location of the carrier unit in a position where characters may be suitably printed, a so called "initialization" is made to bring the print head 6 to a predetermined position from wherever the print head was located (FIG. 15).

This "initialization" is made by moving up the print head 6 (FIG. 2) such that, when the printer switch is turned on, the stepping motor 28 rotates clockwise by ten steps, and then the motor stops. This will rotate the pulley 36 clockwise by ten steps simultaneously with a corresponding clockwise rotation of the cam 34. Upon rotation of the cam 34, the pins 61 and 71, which are engaged in the extreme counterclockwise ends of the openings 82 and 86 respectively in the pulley 36, cause rotation of the spindle 22. Thus, the cam 34 is rotated in a direction such that the distance from the center of the cam to the cam surface is reduced, and the carrier unit 24 is in turn raised by the spring 42. The motor 28 and the pulley 36 are driven counterclockwise so as to move the print head 6 downwardly. The cover tongue 102 of the shielding plate 38 is adapted so as to shift the sensor 104 from a "light" state to a "dark" state; that is, the slit in the sensor 104 is covered with the tongue 102, thereby stopping the motor. This point is designated in FIG. 14 as the "paper position sensing point." Then, the motor 28 is driven clockwise with the pulley 36 to move the print head upwardly. The sensor shielding plate 38 abuts against a stopper 88. In this manner, the cover tongue 102 serves to shift the sensor 104 from a "light" state to a "dark" state; that is the "unit home position sensing point" of FIG. 14, wherein the slit in the sensor 104 is covered with the tongue 102, thereby stopping the motor. This position is identified as the home position.

In this home position, the members such as the sensor holder 32, cam 34, pulley 36, and the sensor shielding plate 38 establish a relative positional relationship with each other shown as the "unit home position sensing point" in FIG. 14. This home position is identified instantaneously with switching on wherever the carrier unit 24 is located.

Figure 16:
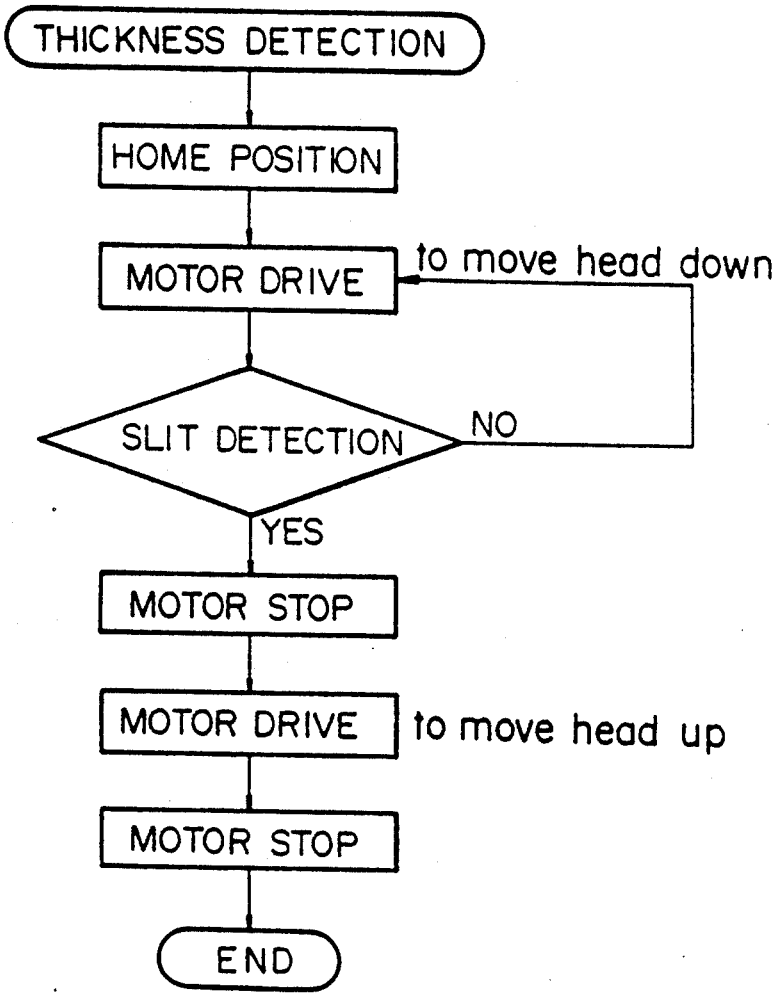
FIG. 16 is a flow chart showing how paper thickness is detected by the instant mechanism or unit.

Referring to FIG. 16, the paper thickness is detected as follows.

After the paper is interposed between the paper guide or the abutment 30 and the platen 31, the abutment 30 is lowered toward the platen 31 to rotate the pulley 36 counterclockwise for abutting against the surface of the paper. This will rotate the cam 34 to its highest point $C_1$ (FIG. 8) where the shielding plate 38 serves to shift the sensor 104. The highest point $C_1$ is actually a position where the abutment 30 abuts against the platen 31 when the paper is not prepared. The position of the cam is moved from the point $C_1$ toward a point $C_2$ to the extent corresponding to the thickness of the paper after insertion of the paper. However, for convenience of explanation hereinafter, the position of the cam after paper insertion is regarded as $C_1$. When the motor 28 is driven in the direction where the print head 6 is lowered (counterclockwise in FIG. 3), force in the counterclockwise direction is imparted to the pulley 36 and the shielding plate 38 by the stepping motor 28. Accordingly, the respective members can be rotated from the "paper position point" to the "paper position sensing point" shown in FIG. 14. At this time, the sensor 104 on the shielding plate 32, connected to the cam 34 by the spring 110, and the cam 34 are prevented from moving. However, the pulley 36 and the shielding plate 38 are rotated counterclockwise to a small extent to allow the shielding plate 38 to shift the sensor 104 from a "light" state to a "dark" state by covering the latter with the tongue 102, thereby assuming the "paper position sensing point" in FIG. 14, whereupon the stepping motor 28 stops. In this state, the position of the paper is electrically sensed without stepping-out the stepping motor.

When the motor and the pulley are rotated clockwise from the above position by ten steps, the sensor 104 switches to a "light" state instead of a "dark" state to assume the "paper position point" of FIG. 14. This position is a reference surface position where the print head 6 is in light contact with the paper surface. It is, however, necessary to keep the print head 6 away from the reference surface a predetermined distance for optimum printing. To this end, the stepping motor 28 (FIG. 16) is eventually rotated by a predetermined step to rotate the pulley 36 clockwise so as to raise the print head a predetermined distance from the reference surface whereupon the motor stops. This is the optimum printing position from which printing is started.

At the top dead point, the carrier unit is positioned to render the ribbon exchangeable. According to the position adjustable unit 26 of the invention, the aforementioned top dead point may be readily obtained by the sequence of operation as will be described hereinafter. Initially, the stepping motor 28 is rotated clockwise to thus rotate the unit 26 to the "unit home position sensing point" of FIG. 14, where the shielding plate 38 abuts against the stopper 88 to stop its rotation. The unit 26 is further rotated clockwise by the stepping motor 28. This will rotate the unit 26 until the lug 84 abuts against an upright wall 97 formed at the other end of the slot 98 in the shielding plate 38 resulting in the abutment of the sensor holder 32 against the sensor 104 of the holder 32.

The aforementioned position is shown as the "unit top dead point" in FIG. 14 where the cam 34 is positioned such that the roller 46 occupies its lowest position. Accordingly, the carrier unit 24 is positioned farthest away from the platen 31 to allow the ribbon in the ribbon cassette to be readily exchanged.

After a desired operation at the "unit top dead point", the stepping motor 28 is rotated counterclockwise to a given extent to readily obtain the "unit home position sensing point", thereby continuing a desired printing operation.

The foregoing is considered as illustrative only of the principals of the present invention and is not limited to the particular embodiments discussed herein. Various changes, substitutions and modifications may be made thereto by those skilled in the art without departing from the spirit or scope of the invention as defined by the appended claims.

What is claimed is:

1. An apparatus using a stepping motor for automatically adjusting a position of a print head without stepping-out, comprising:

a platen for mounting thereon a paper;

a frame;

a shaft extending in a horizontal direction, said shaft being loosely supported by said frame to allow for slight movement of said shaft relative to said platen;

an urging means for resiliently urging said shaft;

a print head slidably mounted on said shaft to move horizontally;

a cam securely fixed to said shaft;

a holder loosely mounted on said shaft;

a sensor attached to said holder;

a pulley loosely mounted on said shaft to rotate said cam;

a shielding plate loosely mounted on said shaft, said shielding plate cooperating with said sensor to position said print head in precise print position;

means for resiliently connecting said holder to said cam;

means for resiliently connecting said pulley to said cam;

means for resiliently connecting said shielding plate to said pulley;

stopper means for limiting movement of said holder relative to said cam;

stopper means for limiting movement of said pulley relative to said cam;

stopper means for limiting movement of said shielding plate relative to said cam;

a roller fixed on said frame for engaging said cam to push said shaft against said urging means;

a stepping motor for rotating said pulley in response to said sensor; and means for continuously rotating said pulley relative to said shaft by a predetermined angle after said print head abuts said paper on said platen;

whereby said sensing means sense the position where said pulley rotates by said predetermined angle to set the position as a basic position.

2. An apparatus for automatically adjusting a position of a carrier unit with a print head to print characters on a paper disposed between said unit and a platen, comprising:

said platen for mounting thereon said paper;

at least a pair of frames;

a shaft extending in a horizontal direction, said shaft being loosely supported by said frame to slightly move relative to said platen;

a cam member outwardly of said frames and rigidly mounted on at least one end of said shaft;

a holder for limiting rotation of said cam member on said shaft;

a detector attached to said holder;

a pulley mounted on said shaft to rotate said cam;

a shielding plate for limiting rotation of said pulley on said shaft, springs for raising opposite ends of said shaft from the surface of said paper;

a roller engageable with said cam member for controlling said shaft in a predetermined position in opposition to the force exerted by said springs;

a stepping motor for rotating said pulley via a belt;

respective springs for supporting said holder and said cam, said cam and said pulley, and said pulley and said shielding plate in a pull relationship with each other, said holder and said pulley being rotatable with respect to said cam, and said shielding plate being rotatable with respect to said pulley at predetermined angles against said cam, said shielding plate being actuated in association with said detector to position said print head to a precise printing position without stepping-out said stepping motor; and means for continuously rotating said pulley relative to said shaft by a predetermined angle after said print head abuts said paper on said platen;

whereby said sensing means sense the position where said pulley rotates by said predetermined angle to set the position as a basic position.

* * * * *